US006321953B1

(12) United States Patent
Nakamura et al.

(10) Patent No.: US 6,321,953 B1
(45) **Date of Patent: *Nov. 27, 2001**

(54) COMPOSITE IMMERSION NOZZLE

(75) Inventors: Ryosuke Nakamura, Oku-Gun; Shigeki Uchida, Bizen; Michinori Yoshikawa, Okayama, all of (JP)

(73) Assignee: Shinagawa Refractories, Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/018,856

(22) Filed: Feb. 4, 1998

(51) Int. Cl.[7] ..... B22D 37/00; B32B 1/08; B65D 25/14

(52) U.S. Cl. ..... 222/590; 164/337; 164/437; 222/591; 222/606; 222/607; 428/34.6; 428/36.91; 428/212; 428/213

(58) Field of Search ..... 428/34.6, 36.9, 428/36.91, 212, 213; 222/606, 607, 590, 591; 164/337, 437

(56) References Cited

U.S. PATENT DOCUMENTS 4,877,705 * 10/1989 Polidor ..... 428/34.6
5,086,957 * 2/1992 Ozeki et al. ..... 222/607

FOREIGN PATENT DOCUMENTS

2135918A * 9/1984 (GB) .
9-277031 * 10/1997 (JP) .

OTHER PUBLICATIONS

N. Lange, ed., Handbook of Chemistry, 9th ed., p. 1678, 1956.*

* cited by examiner

*Primary Examiner*—Harold Pyon
*Assistant Examiner*—Sandra M. Nolan
(74) *Attorney, Agent, or Firm*—Armstrong, Westerman, Hattori, McLeland & Naughton, LLP

(57) ABSTRACT

The present invention provides a composite immersion nozzle, by which it is possible to reduce thermal stress on the nozzle and to prevent occurrence of cracks, whereby there is no restriction on properties of the materials such as thermal expansion coefficient, while fully utilizing properties required for each of the materials such as corrosion resistant property, property to prevent alumina build-up on the nozzle, etc. In an immersion nozzle comprising two types or more of materials, a material having higher thermal expansion coefficient than that of the nozzle main body is arranged on inner side of the nozzle, and a ratio of thickness of the material arranged on the inner side to total thickness of the nozzle is less than 25%.

2 Claims, 7 Drawing Sheets

FIG. 7

| | | ① | ② | ③ | ④*1 | ⑤ | ⑥ | ⑦ | ⑧ | ⑨ |
|---|---|---|---|---|---|---|---|---|---|---|
| Chemical composition (wt %) | $SiO_2$ | 29 | 15 | – | – | <1 | – | – | – | – |
| | $Al_2O_3$ | 39 | 52 | 65 | 57 | 99 | – | – | – | – |
| | MgO | – | – | – | 23 | <1 | – | – | – | – |
| | $ZrO_2$ | – | – | – | – | – | 52 | 25 | 70 | 82 |
| | CaO | – | – | – | – | – | 20 | 26 | 3 | 4 |
| | $TiO_2$ | – | – | – | – | – | – | 20 | – | – |
| | SiC | – | – | 5 | – | – | – | – | 5 | – |
| | C | 32 | 33 | 30 | 20 | – | 28 | 29 | 22 | 14 |
| Physical properties | Bulk specific gravity ($g/cm^3$) | 2.26 | 2.35 | 2.60 | 2.55 | 3.90 | 3.05 | 2.70 | 3.50 | 3.85 |
| | Bending strength (MPa) | 7.0 | 6.8 | 8.5 | 8.0 | 324 | 6.2 | 6.0 | 5.8 | 6.5 |
| | Modulus of elasticity (GPa) | 9.0 | 8.6 | 9.5 | 9.0 | 370 | 7.8 | 7.5 | 8.2 | 8.0 |
| | Thermal expansion coefficient (%) *2) | 0.24 | 0.30 | 0.35 | 0.38 | 0.80 | 0.50 | 0.57 | 0.44 | 0.49 |

*1) Spinel-carbon

*2) Thermal expansion coefficient is represented by the value at 1000° C.

FIG. 8 (a)

| | | Example 1 | Example 2 | Example 3 | Example 4 | Example 5 | Example 6 |
|---|---|---|---|---|---|---|---|
| Arrangement of materials | | Fig. 6a | Fig. 6a | Fig. 6a | Fig. 6a | Fig. 1 | Fig. 1 |
| Total thickness of nozzle (mm) | | 30 | 45 | 60 | 15 | 20 | 50 |
| Main body | Material (See Fig. 7) | ① | ② | ③ | ④ | ① | ③ |
| | Thickness (%) | 0 | 0 | 0 | 0 | 15 | 25 |
| Outer side | Material (See Fig. 7) | ⑧ | ⑨ | ⑧ | ⑧ | ⑨ | ⑨ |
| | Thickness (%) | 90 | 85 | 90 | 75 | 80 | 50 |
| Inner side | Material (See Fig. 7) | ⑥ | ⑥ | ⑦ | ⑦ | ⑦ | ⑥ |
| | Thickness (%) | 10 | 15 | 10 | 25 | 5 | 25 |
| Calculated stress (MPa) *3) | | 1.6 | 1.8 | 1.9 | 1.7 | 1.7 | 1.5 |
| Cracks on full-scale furnace | | None | None | None | None | None | None |

FIG. 8 (b)

| | | Example 7 | Example 8 | Example 9 | Example 10 | Comparative example 1 | Comparative example 2 |
|---|---|---|---|---|---|---|---|
| Arrangement of materials | | Fig. 6a | Fig. 6b | Fig. 6a | Fig. 6b | Fig. 6a | Fig. 6a |
| Total thickness of nozzle (mm) | | 35 | 60 | 55 | 40 | 45 | 30 |
| Main body | Material (See Fig. 7) | ④ | ② | ① | ④ | ③ | ② |
| | Thickness (%) | 0 | 85 | 0 | 97 | 0 | 0 |
| Outer side | Material (See Fig. 7) | ⑧ | – | ⑨ | – | ⑨ | ⑧ |
| | Thickness (%) | 75 | – | 95 | – | 65 | 70 |
| Inner side | Material (See Fig. 7) | ⑥ | ⑦ | ⑤ | ⑤ | ⑥ | ⑦ |
| | Thickness (%) | 25 | 15 | 5 | 3 | 35 | 30 |
| Calculated stress (MPa) *3) | | 1.7 | 2.1 | 1.6 | 1.4 | 2.8 | 3.3 |
| Cracks on full-scale furnace | | None | None | None | None | Cracks occurred in 1st test | Falling-off in 1st test |

*3) Indicates the value of tensile stress

COMPOSITE IMMERSION NOZZLE

The present invention relates to an immersion nozzle used for discharging molten steel, and in particular, to a composite immersion nozzle comprising two or more materials.

In a facility for continuous casting, an immersion nozzle is used when molten steel is injected from tundish into a mold. This immersion nozzle is immersed from its tip to slag line into molten steel filled in the mold and it is provided with functions to prevent splashing when molten steel is injected, to avoid oxidation of the injected molten steel as it is brought into contact with the air, and further to prevent suspended matters from being caught and intermingled in molten steel (hereinafter referred as "slag") such as mold powder or other foreign objects on the surface of the molten steel.

The immersion nozzle as described above should be made of a material, which is very unlikely to cause closure of the nozzle, has corrosion resistant property to molten steel or slag, high spalling resistant property and has high hot strength. However, in case it is made of a single type of refractory material, it is difficult to have the nozzle, which can adapt to complex environment because the upper end, the slag line and inner surface of the nozzle, into which molten steel is injected, are used under different environmental conditions. In this respect, various types of composite immersion nozzles have been known in the past. For example, there have been proposed the following types of nozzles: a nozzle comprising a main body made of alumina-carbon type refractory material and a zirconia-carbon type refractory material layer integrally molded on a slag line portion (outer surface of the nozzle) which is brought into contact with slag (JP-A-3-243259), or a nozzle comprising a main body made of alumina-carbon type refractory material and a layer to prevent alumina build-up on inner surface of the nozzle to avoid clogging of nozzle, or a nozzle comprising a main body made of alumina-carbon type refractory material and a layer to prevent corrosion in inner surface of the nozzle to avoid corrosion of the nozzle (JP-B-6-4509). To prevent cracking, a composite immersion nozzle is known, which attains the purpose by adjusting blending or property of materials of each component, for example, a nozzle comprising a main body material and an inner side material with difference of expansion coefficient within 0.15% (JP-A-56-33155), or a nozzle produced by limiting quantity of zirconia, i.e. a material with high expansion coefficient (JP-A-56-41053).

In the composite immersion nozzle, cracking may occur due to thermal stress when receiving molten steel because the material properties of the components are different. To prevent cracking, JP-A-56-41053 describes the condition that expansion coefficient of the material on inner side of the nozzle should be equal to or lower than that of the material of the nozzle main body and that the difference of the expansion coefficient between the two materials should be within about 0.15%. JP-A-56-33155 describes the prevention of cracking by limiting the blending quantity of zirconia (to 90% or less) in the material on the inner side of the nozzle to decrease expansion coefficient.

However, such conditions cannot be maintained in many cases in order to ensure good quality of cast piece or to attain stability of molten steel injection.

SUMMARY OF THE INVENTION

To solve the above problems, it is an object of the present invention to provide a composite immersion nozzle, which comprises two types or more of materials, whereby there is no restriction on the properties of the materials such as thermal expansion coefficient, and thermal stress on the nozzle is reduced to prevent cracking, while fully utilizing the properties required for each of the materials such as corrosion resistant property or property to prevent alumina build up on the nozzle.

The present inventors have been making efforts to study shapes of the immersion nozzle, in which cracking is most unlikely to occur by simulating occurrence of various types of cracks generated in the immersion nozzle and phenomenon of cracks by calculation of thermal stress. During the course of the study, it has been found that, in case of a composite immersion nozzle comprising two types or more of materials, due to arrangement of the materials, there is difference in the value of thermal stress, which is the direct cause of cracks generated in nozzle even when the shape of the entire nozzle is the same, and the concept of the present invention has been attained.

The composite immersion nozzle of the present invention comprises two types or more of materials, and it is characterized in that, when a material having higher thermal expansion coefficient than the main body of the nozzle is arranged on inner side, thickness of the material arranged on the inner side is less than 25% to total thickness, and also that, when a material different from that of the nozzle main body is arranged on outer side of the nozzle, the material of the nozzle main body is placed between the material of the inner side and the material of the outer side.

BRIEF DESCRIPTION OF THE DRAWINGS

FIG. 7 is a table to explain the materials of the nozzle; and

FIG. 8 shows the results of a test on examples and comparative examples.

DESCRIPTION OF THE PREFERRED EMBODIMENTS

Figure 1:
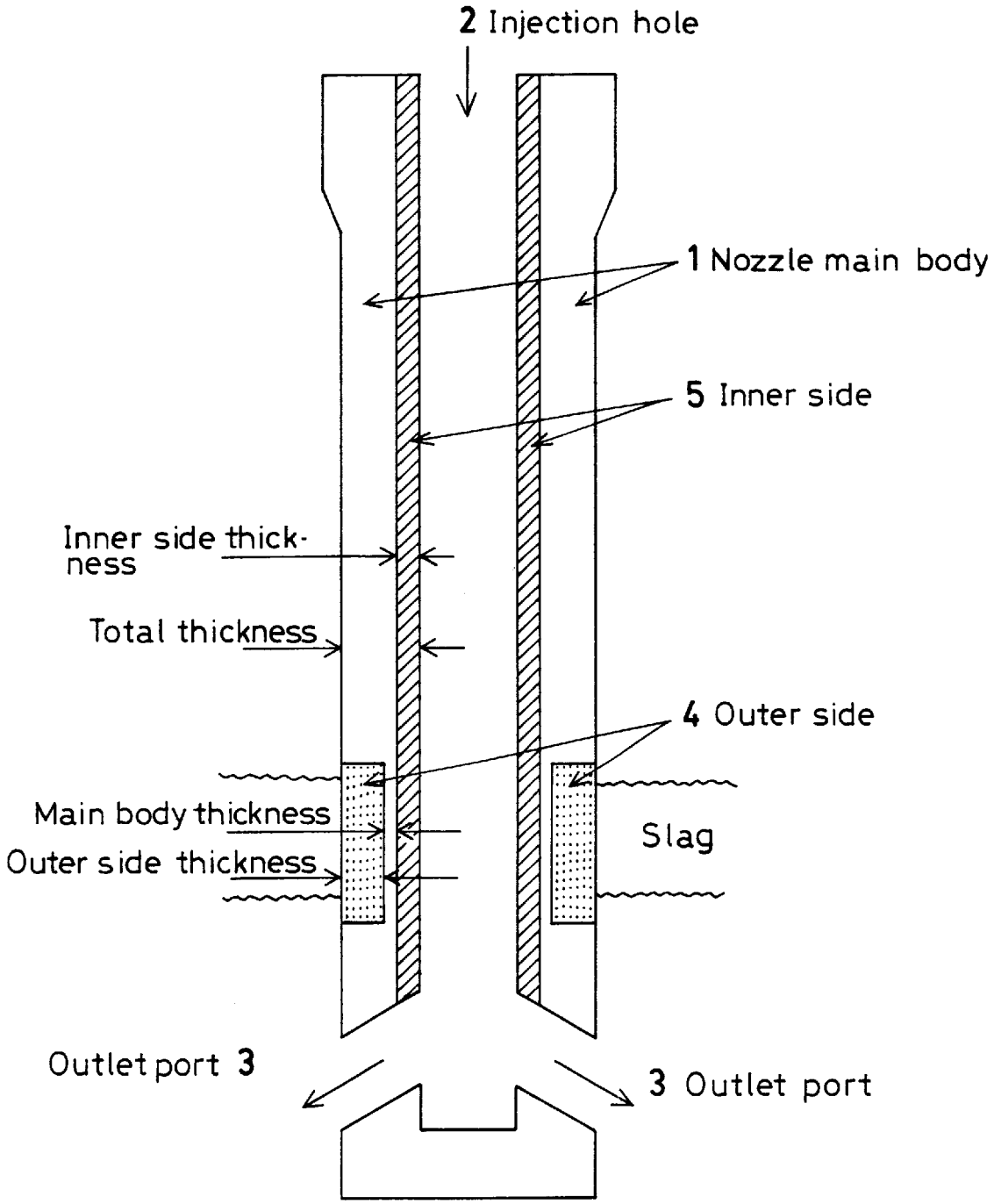
FIG. 1 is a cross-sectional view schematically showing a structure of a composite immersion nozzle of the present invention.

In the following, detailed description will be given on the present invention:

FIG. 1 is a cross-sectional view schematically showing the structure of a composite immersion nozzle, in which generation of thermal stress has been studied. Molten steel heated at about 1600° C. comes out of a tundish and enters through an injection hole 2 on the upper portion of the immersion nozzle and is discharged through an outlet port 3 on the lower portion and is poured into a mold. In this case, the immersion nozzle is immersed in the molten steel inside the mold in order that oxidation caused by contact of the molten steel with external air is prevented and that slag floating on the molten steel in the mold may not be stirred up.

In the immersion nozzle used under the conditions as described above, an inner side 5 where molten steel passes through and an outer side 4 which comes into contact with slag must have properties different from those of the main body. It is important that the material of the main body 1 has such property as to be most unlikely to crack due to rapid heating when the molten steel heated at about 1600° C. begins to pour. The material of the inner side 5 must have such a property that clogging of the bore of nozzle caused by alumina build-up on inner side can be prevented in case a type of steel having high alumina content is handled, and also such a property that corrosion by the molten steel is very unlikely to occur in case a type of steel which may easily corrode the material of the main body 1 is handled. The material of the outer side 4 is brought into contact with slag. Because the slag has a property to easily corrode refractory material compared with the molten steel, the material of the outer side 4 must have higher corrosion resistant property than the main body 1. As described above, the properties required are different according to the site on the nozzle, and naturally, mechanical properties of the materials used for the main body 1, the inner side 5, and the outer side 4 (e.g. strength, thermal expansion coefficient) are different from each other.

In the following, thickness of each of the materials of the main body, the inner side and the outer side is referred as main body thickness, inner side thickness, and outer side thickness respectively. Specifically, as shown in FIG. 1, the outer side thickness is defined as a dimension from outer surface of the nozzle (as measured toward inner side) to a portion where the material of the outer side is in contact with the other material. The inner side thickness is defined as a dimension from inner surface of the nozzle (as measured toward outer side) to a portion where the material of the inner side is in contact with the other material.

Also, the main body thickness is defined as a dimension from a site where the material of the inner side contacts the other material to a site where the material of the outer side contacts the other material. A total dimension including the main body thickness, the inner side thickness and the outer side thickness, i.e. a dimension from the inner side to the outer side of the nozzle, is called as total thickness.

In general, it is known that damage such as crack occurs when a stress, generated due to temperature change or to a combination of different materials, exceeds strength of the material at that site. That is, if the generated stress is lower than the material strength, no crack occurs. In the relationship between the generated stress and the material strength, tensile stress corresponds to tensile strength, and compressive stress corresponds to compressive strength.

Based on the above reasons, detailed study was performed on generation of cracks according to the relationship between the value of the generated stress as estimated by calculation and the material strength.

Basic Conditions of Calculation

To evaluate how the inner side thickness and the difference of expansion coefficient between the nozzle main body material and the inner side material exert influence on cracks generated in the nozzle, a nozzle was used, which comprises alumina-carbon material as the main body, zirconia-carbon material or magnesia-carbon material as the outer side, calcia-titania calcia-zirconia carbon material, or calcia-zirconia-carbon material or zirconia-carbon material as the inner side. With the total thickness of 15 mm to 50 mm and the inner side thickness of 0 mm to 25 mm, calculation was made by assuming the cases where combination of total thickness and the inner side thickness was varied.

Evaluation of Inner side Thickness

In order to elucidate the influence of the inner side thickness (i.e. to exclude influence of the difference of expansion coefficient between the main body material and the inner side material), among the combinations of the above materials, such combinations of materials were selected, in which the difference of expansion coefficient between the main body material and the inner side material is within the range of 0.30 to 0.35.

Figure 2:
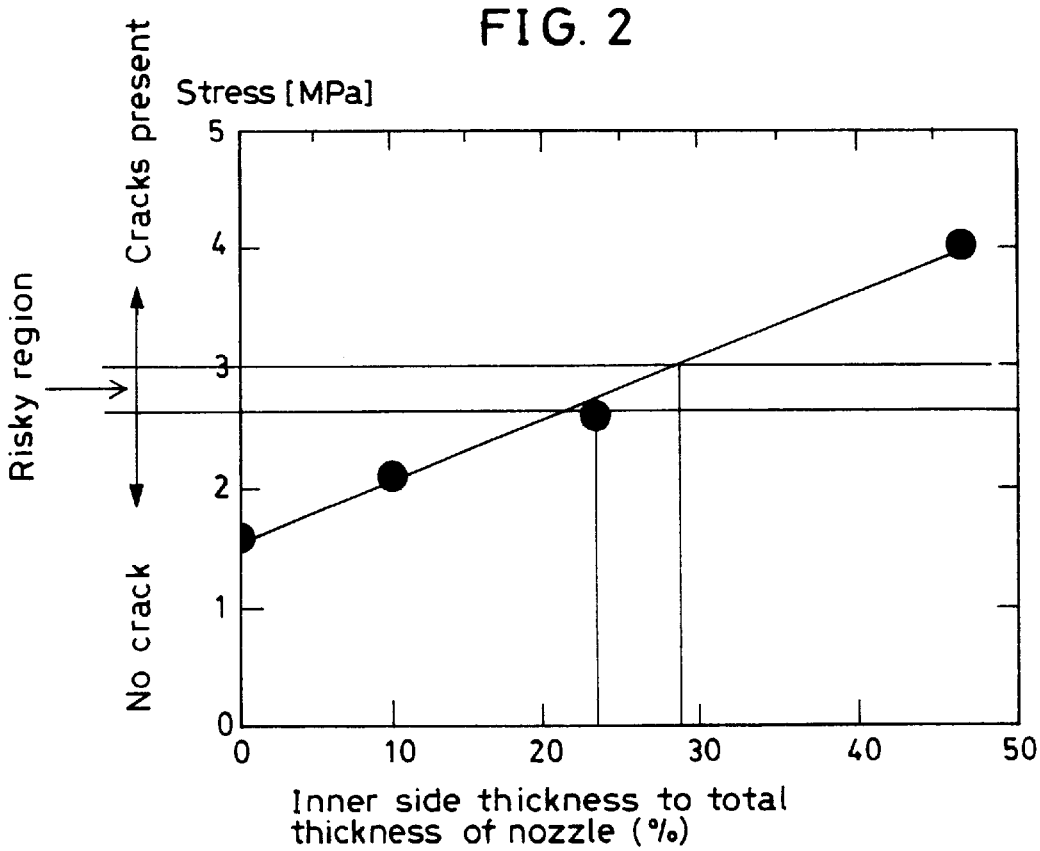
FIG. 2 is a diagram showing relationship between a ratio of an inner side thickness to total thickness of the nozzle and stress.

FIG. 2 is a diagram showing the relationship between the stress generated and a ratio of the inner side thickness to total thickness. As the ratio of the inner side thickness to total thickness is decreased, the generated stress decreases (i.e. crack is unlikely to occur). In the regions shown in FIG. 2, the region marked with "no crack" indicates the region where no crack occurred in practical use, the region marked with "cracks present" indicates the region where crack occurred in practical use, and the region marked with "risky region" indicates a region where crack occurred in some part of the region and did not occur in some other part of the region in practical use. Therefore, based on these results, the ratio of the inner side thickness to total thickness needed to prevent generation of crack is calculated as about 25% or less.

Evaluation of Difference of Expansion Coefficient

In FIG. 2, it is assumed that the difference of expansion coefficient between the main body material and the inner side material is approximately at a constant level, and it could not be clearly identified how the difference of expansion coefficient between the main body material and the inner side material exerts influence on the generated stress. The results of the evaluation will be described below.

Figure 3:
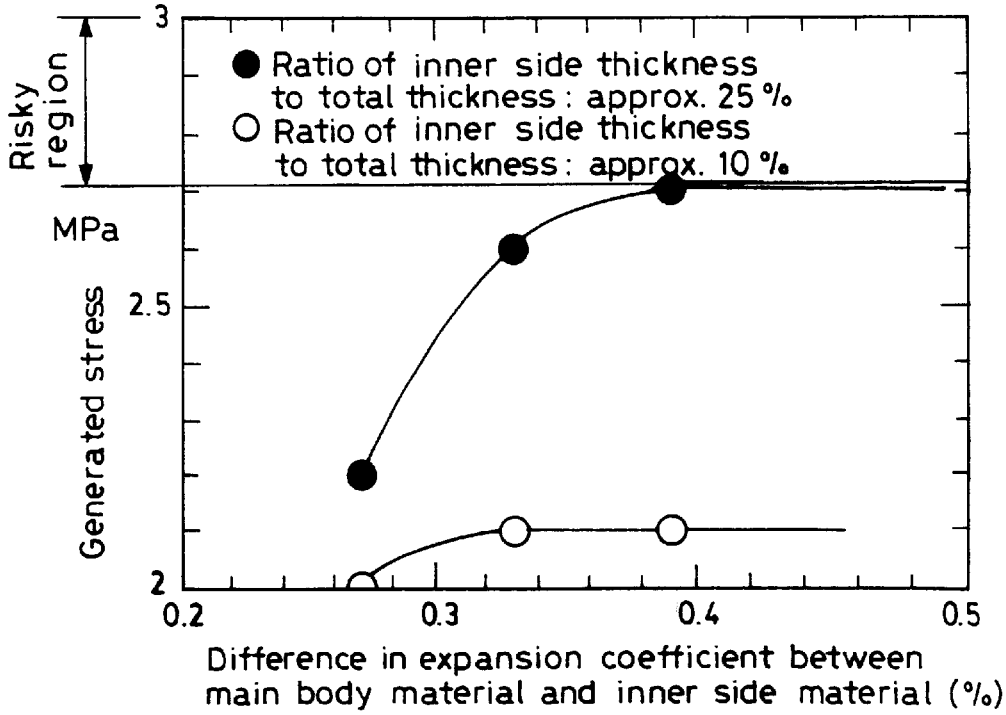
FIG. 3 is a diagram showing relationship of a difference of expansion coefficient between a main body material and a material of inner side material and generated stress.

FIG. 3 shows the results of the evaluation when the difference of expansion coefficient between the main body material and the inner side material is varied in the case where the ratio of the inner side thickness to total thickness is about 25% and in the case where it is about 10%. In case where the ratio of the inner side thickness to total thickness is about 25% (shown by the mark ● in FIG. 3), the generated stress increases with the increase of the difference of expansion coefficient between the main body material and the inner side material, while it is converged toward the upper limit value of the "no crack" region. (Even when the difference of expansion coefficient between the main body material and the inner side material is increased, stress is not generated in the risky region, and no crack occurs.) In case where the ratio of the inner side thickness to total thickness is about 10% (shown by ○ in FIG. 3), the value is extremely small compared with the case where the ratio of the inner side thickness to total thickness is about 25%. That is, if the ratio of the inner side thickness to total thickness is less than about 25%, no crack occurs regardless of the difference of expansion coefficient between the main body material and the inner side material.

To evaluate the influence of the length of the inner side material in the direction of height, stress was calculated in the case where it was arranged only for 3% of the length of nozzle above an outlet port of the nozzle. As a result, exactly the same value of stress was generated in case where it was arranged all the way in height direction and in case where it was arranged only for 3% of the length of nozzle, regardless of the ratio of the inner side thickness to total thickness. Specifically, in case the inner side material is arranged only near the outlet port and in case where it is arranged all the way in height direction, no crack occurs regardless of difference of expansion coefficient between the main body material and the inner side material if the ratio of the inner side thickness to total thickness is less than about 25%. Also, the inner side material may be arranged by distributing it to a plurality of sites.

Calculation was made for the case where the inner side material was extended to the region around the outlet port (FIG. 4*a*), and it was found that the stress reached the risky region in none of the cases, and no crack occurred in the region where the inner side thickness was less than 25%.

Figures 4A, 4B:
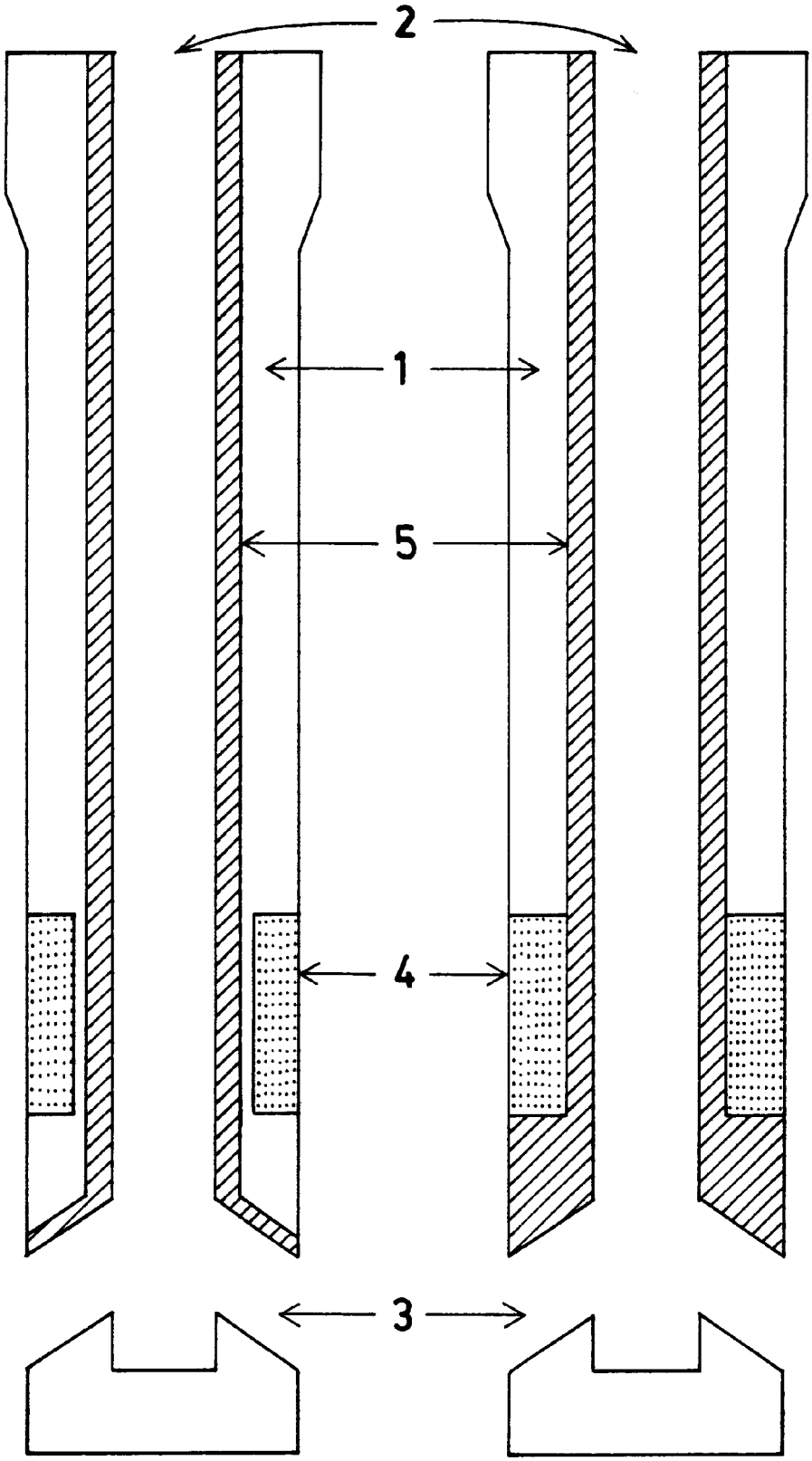
FIG. 4 is a cross-sectional view schematically showing the structure of a composite immersion nozzle.

Compared with the case where the main body material was used, the stress did not increase and rather showed a tendency to decrease in case the same material as that of the inner side was used for the tip site of the main body (FIG. 4*b*). Therefore, even when other material (i.e. a material having expansion coefficient which is between expansion coefficient of the main body material and that of the inner side material) was used for the tip site of the main body, no crack occurred if the ratio of the inner side thickness to total thickness was less than 25%.

Various materials are used as the materials for the main body, the outer side and the inner side of the nozzle. In the materials widely used at present, e.g. a material combining alumina or zirconia with carbon, or a material combining CaO-containing mineral such as $CaO{\cdot}ZrO_2$, $CaO{\cdot}TiO_2$, $CaO{\cdot}SiO_2$, etc. and carbon, the relationship between modulus of elasticity and strength is within the range of the following equation (both modulus of elasticity and strength are represented by the values at room temperature):

$$0.7\times10^{-3} \leqq \text{Bending strength/Modulus of elasticity} \leqq 1.0\times10^{-3} \quad (1)$$

where bending strength was determined by 3-point bending, and modulus of elasticity was measured by resonance method. If it is within the range of the equation (1), the inner side thickness necessary to prevent generation of crack is less than about 25%. In a specific case, however, there may be a material, which is out of the range of the equation (1). In such case, the value calculated by the equation (1) is less than the value of $0.7\times10^{-3}$, and it means that the strength is relatively decreased. Accordingly, it is desirable to set the inner side thickness to less than about 20% in order to reduce the generated stress to a lower value.

Further, in case where relative strength of the material to be used for nozzle is low, i.e. in case the value calculated by the equation (1) is less than the value of $0.5\times10^{-3}$, it is desirable that the ratio of the inner side thickness to total thickness is less than about 15%.

In case the value calculated by the equation (1) exceeds the value of $1.0\times10^{-3}$, it indicates that the strength is relatively high. Because no crack occurs even when the generated stress is high, the inner side thickness can be made thicker so that the ratio to total thickness will be less than about 40%.

In Case Three Types of Materials are Used

Figure 5:
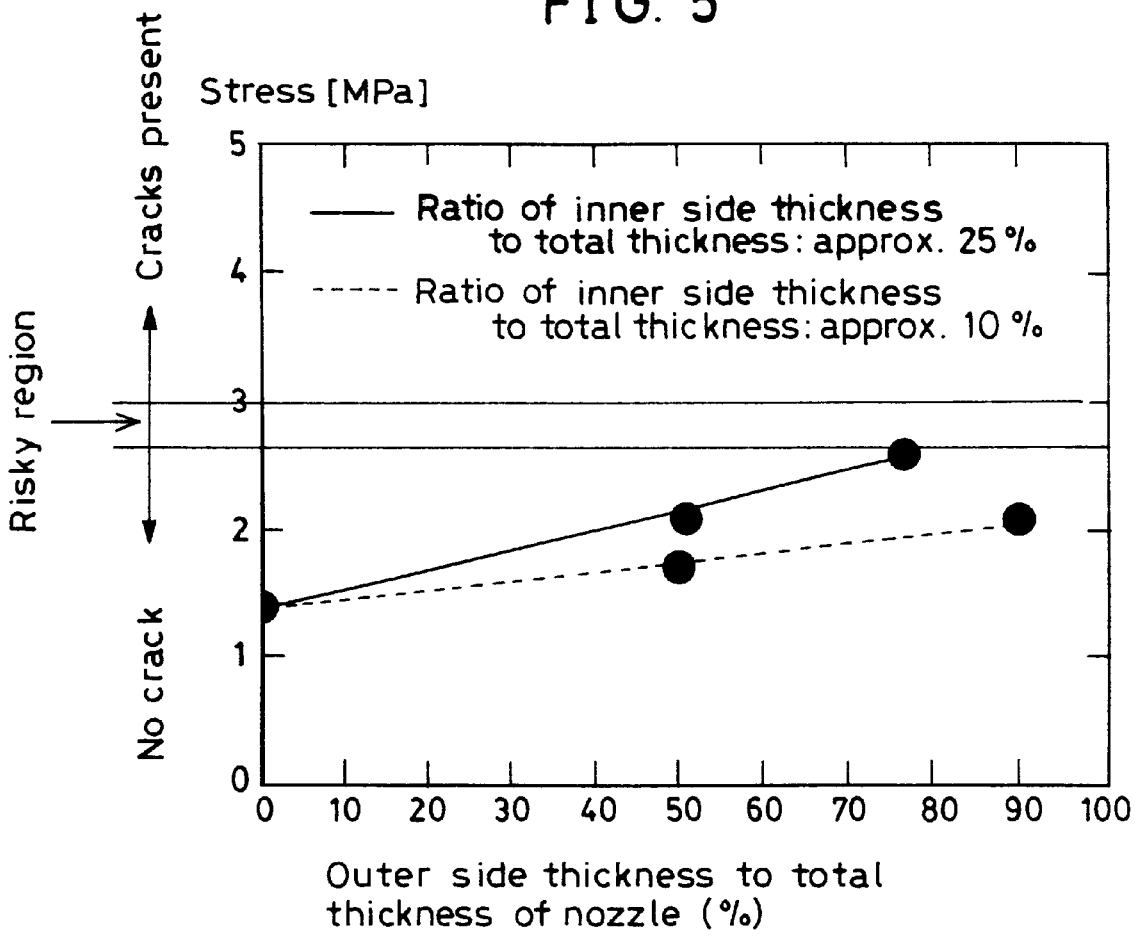
FIG. 5 shows relationship between a ratio of an outer side thickness to total thickness of the nozzle and stress.
Figure 6:
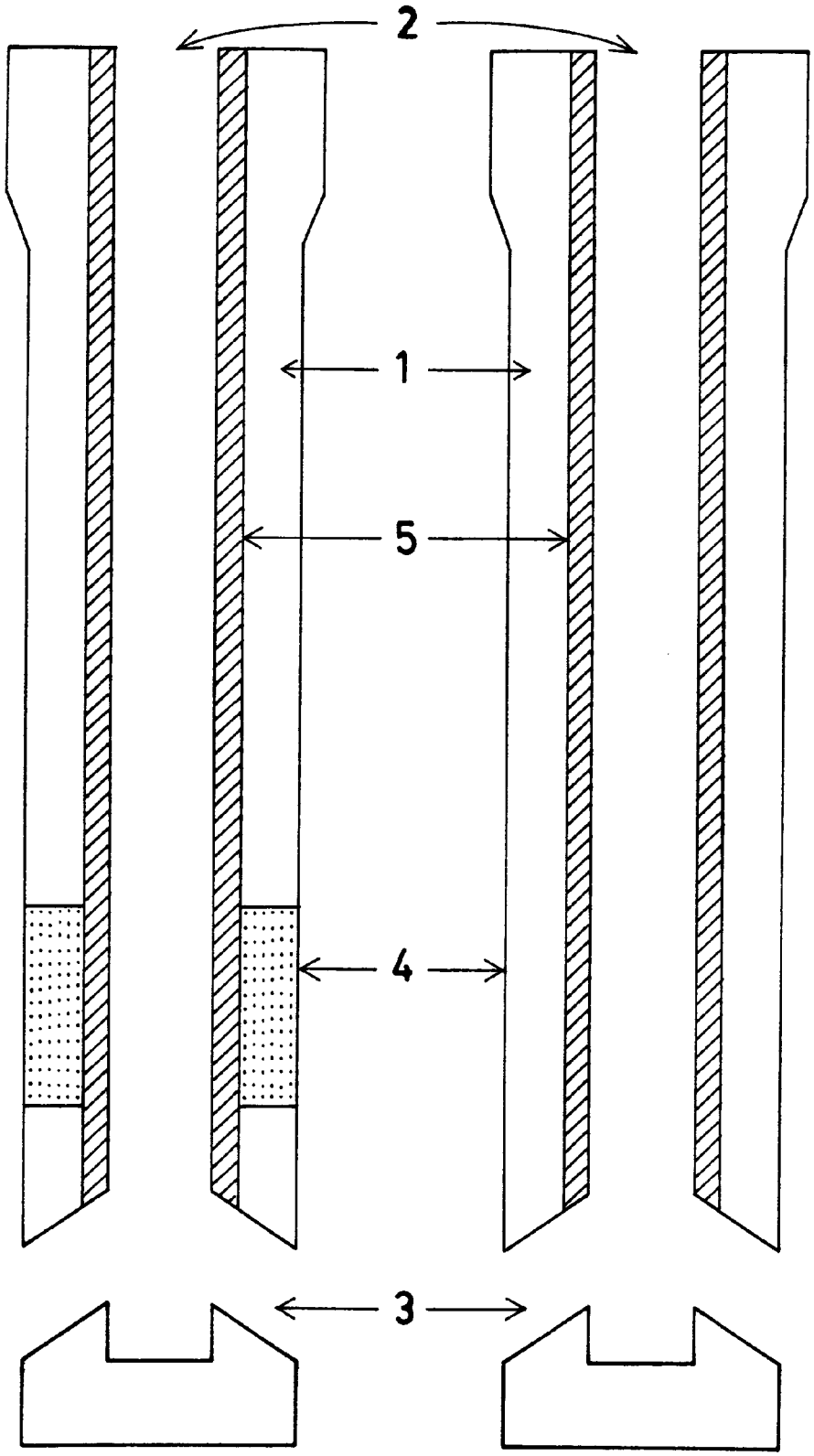
FIG. 6 is a cross-sectional view schematically showing the structure of a composite immersion nozzle.

It is known that, in case stress repeatedly occurs, damage may be caused by stress which is lower than the strength of the material used at that site. To cope with such a case, it was attempted to find a method to determine further decrease of stress. The results are shown in FIG. 5. In FIG. 5, solid line indicates the case where the ratio of the inner side thickness to total thickness is about 25%, and broken line indicates the case where the ratio of the inner side thickness is about 10%. In case the ratio of the inner side thickness is 25% and if the ratio of the outer side thickness is 75%, total sum of the inner side thickness and the outer side thickness reaches 100%. This means that the main body material is not placed between the inner side material and the outer side material (FIG. 6*a*). In case where the ratio of the inner side thickness is 25% and if the ratio of the outer side thickness is 50%, main body material is placed at a ratio of 25% between the inner side material and the outer side material (FIG. 1). Also, if the ratio of the outer side thickness is 0%, it means that the outer side material is not used (FIG. 6*b*).

As it is evident from FIG. 5, when the outer side thickness is made thinner (when the main body material is placed between the outer side and the inner side), stress is extensively decreased. Even in case where stress repeatedly occurs due to vibration, temperature change, etc., if the ratio of the inner side thickness to total thickness is less than 25%, and the main body material is placed between the outer side and the inner side, no crack occurs.

Refractory Material Used in the Present Invention

There is no special restriction on the refractory material used for the composite immersion nozzle of the present invention. Any oxide comprising $Al_2O_3$, $SiO_2$, MgO, $ZrO_2$, CaO, $TiO_2$, $Cr_2O_3$, etc. may be used alone or in combination with carbon such as flake graphite, artificial graphite, carbon black, etc. As the starting raw material, a material containing one type of the above oxides as main component, e.g. alumina, zirconia, etc., may be used. Using a material comprising two types or more of the oxides, e.g. mullite comprising $Al_2O_3$ and $SiO_2$ or spinel comprising $Al_2O_3$ and MgO, and by adjusting and blending these to satisfy the required properties of the material at each site of the immersion nozzle, the refractory material is produced. Also, carbide such as SiC, TiC, $Cr_3C_2$, etc. or boride such as $ZrB_2$ or $TiB_2$, etc. may be added with the purpose of preventing oxidation or for sintering control.

To verify the effects of the present invention, a test was performed in a full-scale facility for continuous casting under the operation. The nozzle used for the experiment was produced by combining various types of materials shown in FIG. 7 and by varying the total thickness of the nozzle to different values. After using this nozzle continuously by three heat changes, the occurrence of cracks was examined. The results of the test as well as combination of materials, total thickness of the nozzle, and arrangement of the materials are shown in FIG. 8.

As it is evident from FIG. 8, in Comparative Example 2 based on the conventional method, crack was found in the first test, and falling-off occurred. Compared with Comparative Example 2, the difference of expansion coefficient was small in Comparative Example 1, and falling-off did not occur, but cracks occurred and the product was not suitable for continuous use. In contrast, the product according to the present invention developed no crack after experiment and was considered as fully suitable for continuous use.

What is claimed is:

1. A composite immersion nozzle, comprising:

a main body of a first material, said main body having a hole inside;

an inner side covering at least part of said hole of said main body, said inner side made of a second material having higher thermal expansion coefficient than that of the first material, wherein the ratio of the thickness of the inner side to a total thickness of the composite immersion nozzle is less than 25%, said inner side is in direct contact with said main body, wherein bending strength and modulus of elasticity of the main body or the inner side covering of the nozzle satisfy the following relation:

$0.7\times10^{-3} \leqq$ (bending strength)/(modulus of elasticity) $\leqq 1.0\times10^{-3}$, where the bending strength is determined by 3-point bending and the modulus of elasticity is measured by resonance method.

2. A composite immersion nozzle according to claim 1, further comprising an outer side covering the main body, said outer side made of a material different from both the first material of the main body and the second material of the inner side.

* * * * *